US005732987A

United States Patent [19]

Wright et al.

[11] Patent Number: 5,732,987

[45] Date of Patent: Mar. 31, 1998

[54] LATCH

[75] Inventors: Andrew Charles Walden Wright, Surrey; Simon Robert Beauchamp, Hants, both of England

[73] Assignee: Dzus Fastener Europe Limited, Farnham, United Kingdom

[21] Appl. No.: 507,288

[22] PCT Filed: May 17, 1994

[86] PCT No.: PCT/GB94/01048

§ 371 Date: Aug. 29, 1995

§ 102(e) Date: Aug. 29, 1995

[87] PCT Pub. No.: WO94/27014

PCT Pub. Date: Nov. 24, 1994

[30] Foreign Application Priority Data

May 19, 1993 [GB] United Kingdom ..... 9310255
May 19, 1995 [GB] United Kingdom ..... 9310254

[51] Int. Cl.[6] ..... E05C 19/12

[52] U.S. Cl. ..... 292/113; 292/247

[58] Field of Search ..... 292/DIG. 49, 113, 292/247, 250, 108

[56] References Cited

U.S. PATENT DOCUMENTS

| | | | |
|---|---|---|---|
| 3,394,955 | 7/1968 | Martin | 292/113 |
| 3,630,559 | 12/1971 | Rawson et al. | 292/113 |
| 4,493,133 | 1/1985 | Nilsson | 292/247 X |

FOREIGN PATENT DOCUMENTS

| | | | |
|---|---|---|---|
| 722536 | 3/1932 | France . | |
| 1222501 | 1/1960 | France | 292/113 |
| 1575335 | 9/1970 | Germany . | |
| 9108578 | 10/1991 | Germany . | |
| 645297 | 1/1979 | U.S.S.R. | 292/113 |
| 8502880 | 7/1985 | WIPO . | |

*Primary Examiner*—Rodney M. Lindsey

[57] ABSTRACT

A latch comprises a support block which, in use, is attached to a first member, and a strike block which, in use, is attached to a second member. A first lever is attached to the support block and shaped to engage with the strike block when the first and second members come into contact. A link member is pivotally attached to the support block. A second lever is pivotally attached to the link member and is shaped to engage with the strike block, with a third lever, pivotally attached to the link member and engageable with the support block, to retain the latch in a latched position. Biasing means biases the third lever into engagement with the support block when the second lever is in its engaged position.

11 Claims, 6 Drawing Sheets

LATCH

This invention relates to latches of the type used to latch together two parts of an item, such as the lid and body of a container.

There are many forms of latch which have been used for a number of years for closing and sealing functions. Such latches, whilst being cheap and simple to manufacture often have the problem that they require manual operation to be closed and do not provide an indication to the user when they are not in a fully latched state.

An example of such a latch would be the toggle type which comprises a first lever attached to an item, and a second lever which pivots on the first lever, engages with a latching surface, and locks in an over-centre pivot action. Such latches are cheap to manufacture, simple to use and reliable even in harsh environments. These latches do, however, have the problem that it is difficult to determine when they are securely latched and that they can, occasionally, be jarred open by vibrations.

Attempts have been made to overcome these problems by provision of either a slide type secondary lock with a catch moving axially in the latch's lever, or by a spring catch type mechanism, where a steel latch engages from the base through the lever to latch. Both of these solutions can suffer from corrosion or jamming from dirt entering the mechanism and often have a "cheap" feel to their operation. Automatically closing latches are also available, but do not generally provide a strongly sealed closure and are vibration sensitive.

There is a need therefore for a latch which closes automatically to provide a safe and secure closure but which may also provide a tight, vibration resistant closure. There is also a need to provide a latch which provides an indication that it is fully closed.

According to the present invention a latch comprises:

- a support block which, in use, is attached to a first member;
- a strike block which, in use, is attached to a second member;
- a first lever attached to the support block and shaped to engage with the strike block when the first and second members come into contact;
- a link member, pivotally attached to the support block;
- a second lever, pivotally attached to the link member and shaped to engage with the strike block;
- a third lever, pivotally attached to the link member and engagable with the support block, to retain the latch in a latched position; and,
- biasing means for biasing the third lever into engagement with the support block when the second lever is in its engaged position.

Because the first lever automatically engages with the strike block, the two members will be latched even if the user does not bring the second lever into engagement, thus ensuring that the item is always safely fastened on engagement of the two members.

Also, as the third lever is biased into engagement with the support block, the latch will not be jarred free by vibration or accidental snagging and, since the third lever must be depressed prior to the latch being released, accidental opening of the latch is unlikely.

The strike block may comprise two components, the first of which engages with the first lever, and the second of which is adjustably mounted on the first to provide an adjustable engagement with the second lever.

The biasing means may be a spring or a combination of springs, and may also act to bias the second lever into a warning position when it is not fully engaged and/or bias the first lever towards an engaging position.

The second lever is preferably biased to a position in which it "flags" the fact that the latch is not engaged, ie the free end of the second lever projects outwardly from the latch.

Advantageously, there is a common biasing means for the second lever and the third lever. The biasing means will usually be a spring, which can be attached to the support block or first lever at one end and attached to the third lever at its other end. The biasing means may, however, be a torsion spring attached to the third lever and in engagement with the first lever, the second lever or support block to bias the third lever toward an engaged position.

Because the third lever engages with the support block when the latch is in a closed position, the latch provides a more secure fixing, which is less likely to become disengaged during excessive vibration of the latch assembly. Also, as the third lever must be released before the latch will disengage, there is a reduced possibility of the latch being opened accidentally.

Examples of a latches according to the present invention will now be described with reference to the accompanying drawings in which.

Figure 1:
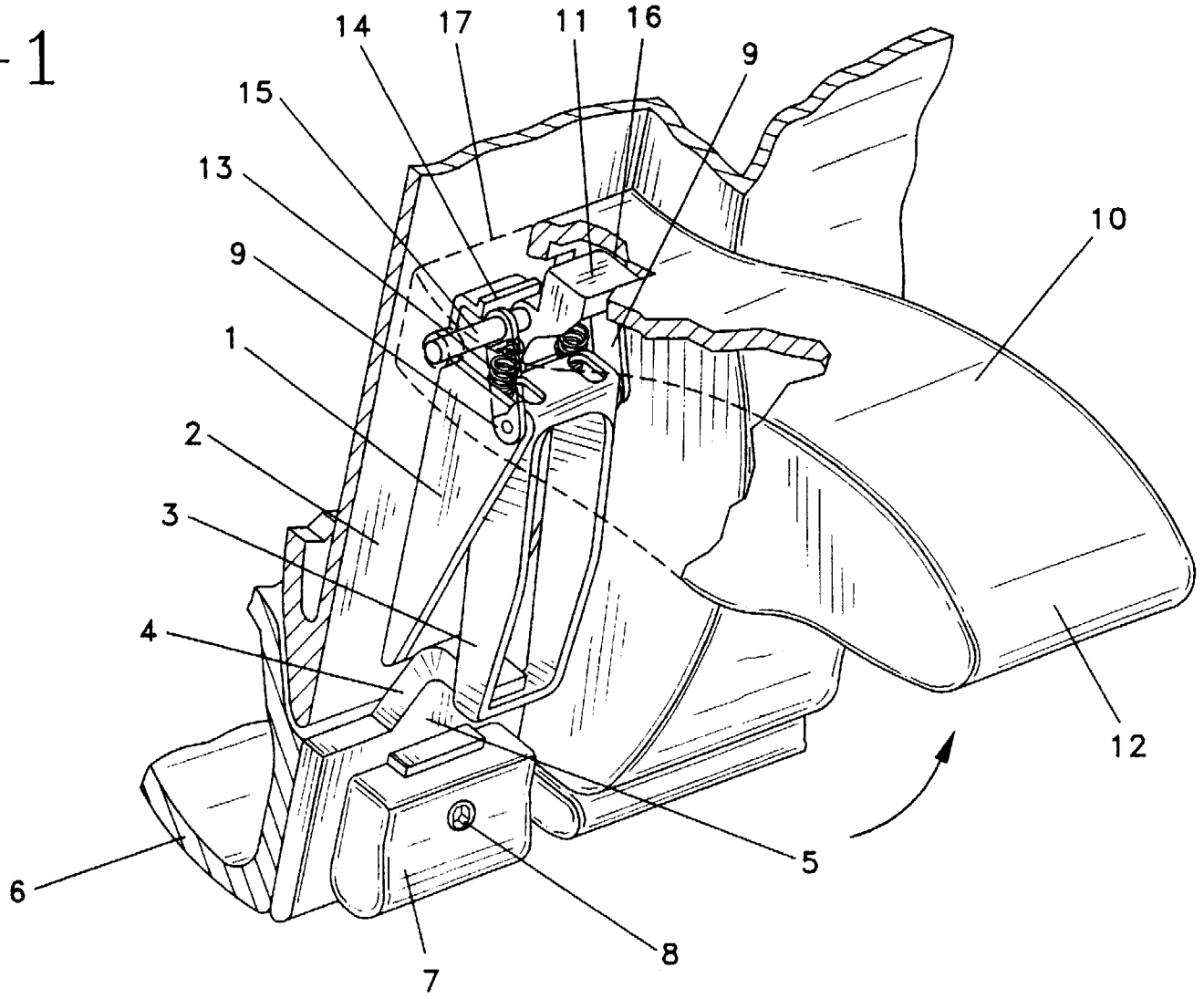
FIG. 1 is a diagram showing a first exhale latch in a released position.

Referring to FIG. 1, a support block 1 is attached to a first member 2 which forms part of the item to be latched. Attached to the support block 1 is a first lever 3 which is shaped at one end to engage with a hook portion 4 of a strike block 5, attached to a second member 6 of the item to be latched, and which comprises two components 4,7. The first of these components 4 comprises a hook and engages with the first lever 3 and the second component 7 is adjustably connected via a bolt 8 to the component 4 and can be used to adjust the tightness of the seal provided by the latch. The first lever 3 and the hook 4 are arranged so that, when the two members 2,6 are brought into engagement, the first lever 3 rides over the hook 4 and latches to it.

Pivotally connected to the support block 1 are two link members 9, and pivotally connected to these two link members 9 are a second lever 10 and a third lever 11. One end 12 of the second lever 10 is shaped so that, when the latch is in a fully closed position, it engages with the component 7 of the strike block 5 to provide a tight, sealed closure as will be described below.

Figure 3:
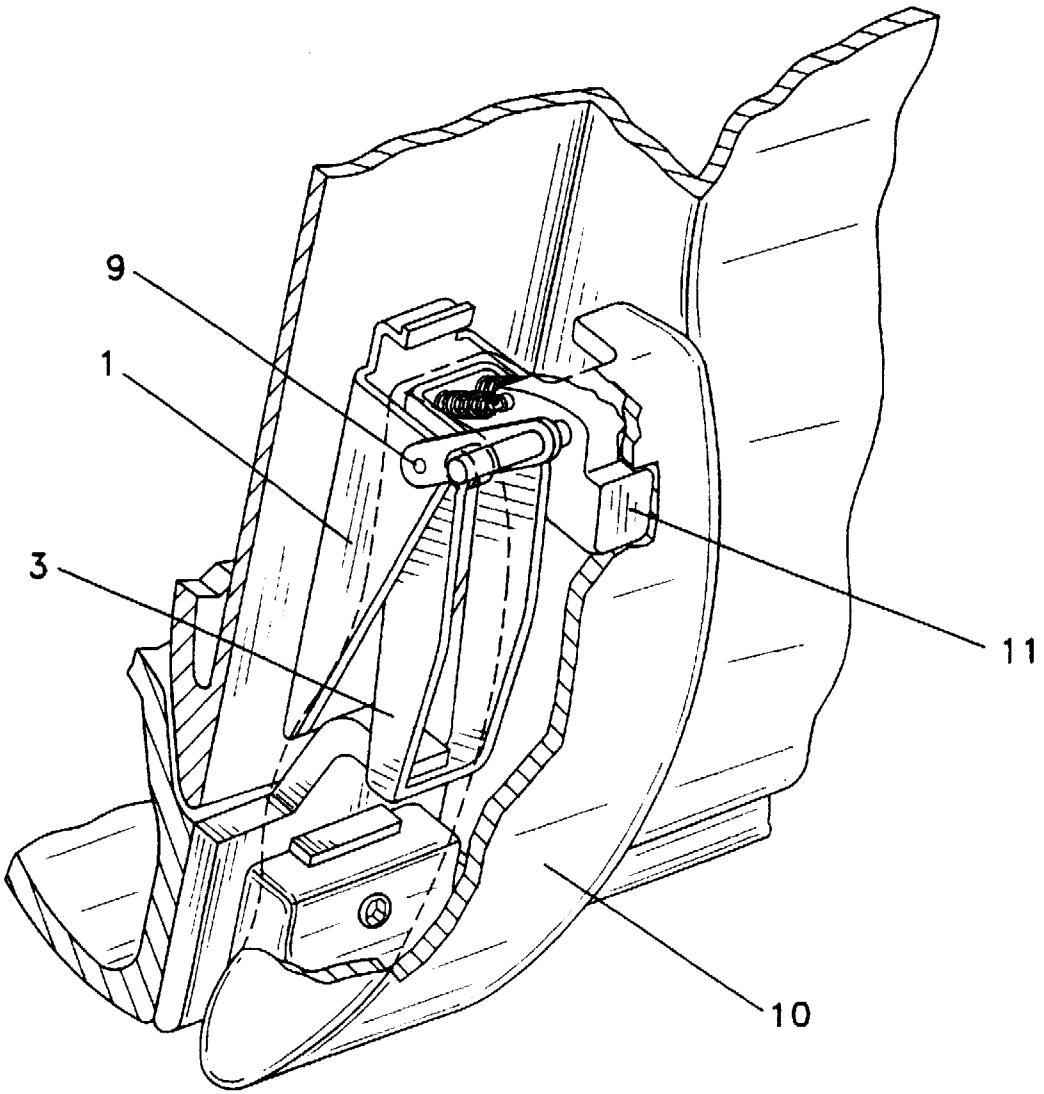
FIG. 3 is a diagram showing the first example latch in a partially closed, but not fully engaged position.

When the first lever 3 has engaged with the strike block 5, the second lever 10 is urged to protrude outwards by the action of a biasing spring 15 via the third lever 11, which rests in a recess 16 in the second lever 10 and engages with it to rotate the second lever 10 in a direction away from the strike block 5, providing an indication to a user that the latch is not fully closed. Rotation of the second lever 10 toward the strike block 5 also rotates the third lever 11, as the second and third levers 10,11 engage with each other, and brings a hooked end 13 of the third lever 11 into a position above a lip 14 on the support block 1 (see FIG. 3). The link members 9 provide an over-centre pivot action similar to that of a toggle latch of the type described above.

Figure 4:
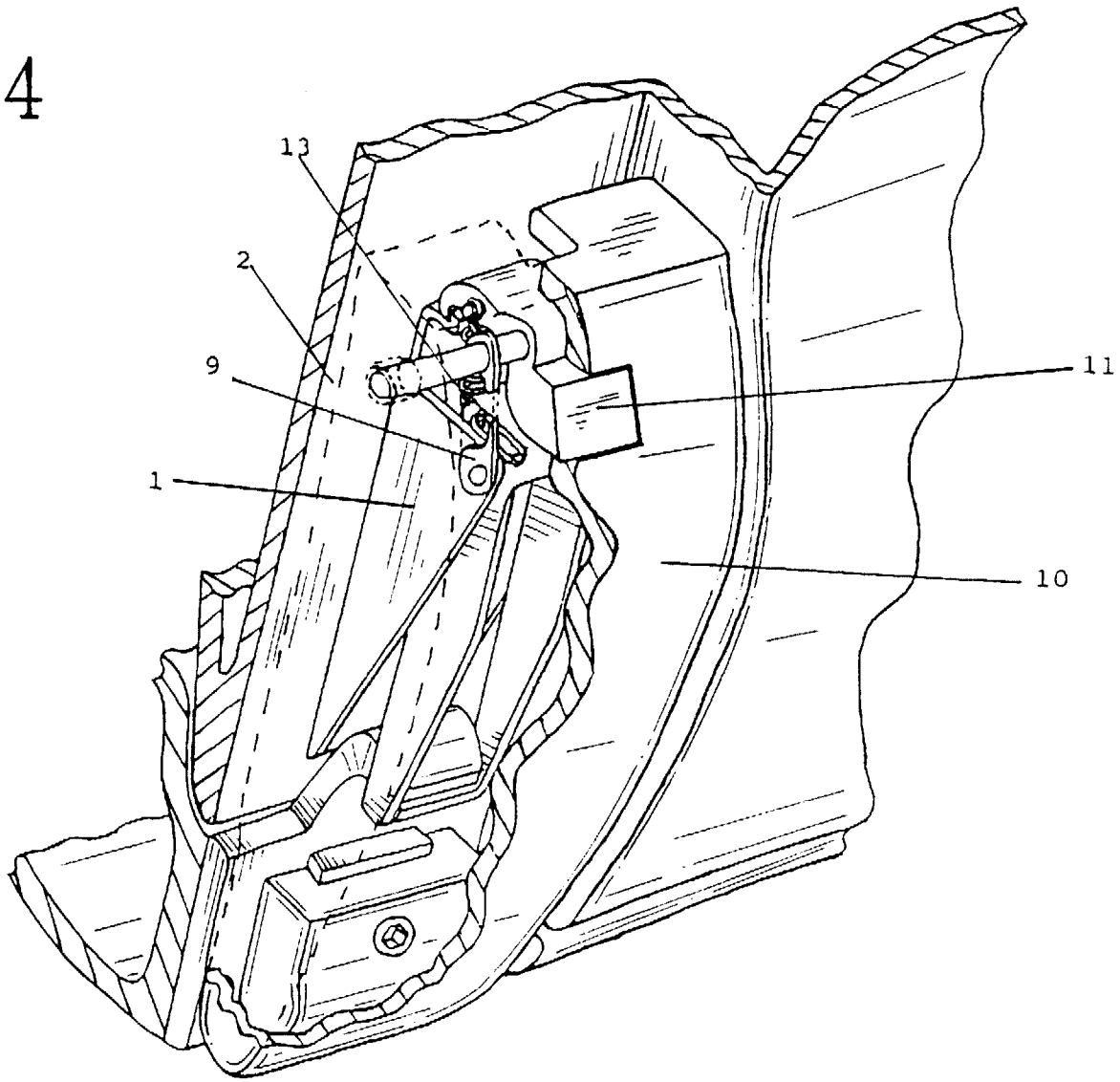
FIG. 4 is a diagram showing the first example latch in a fully engaged position.

To fully close the latch, a user then applies pressure to the pivotally connected end 17 of second lever 10 and/or the third lever 11 to engage the hooked end 13 with the lip 14 (see FIG. 4). The biasing spring 15 connected to the third lever 11 and the first lever 3 retains the hooked end 13 on the lip 14 to prevent accidental release of the latch.

Figure 2:
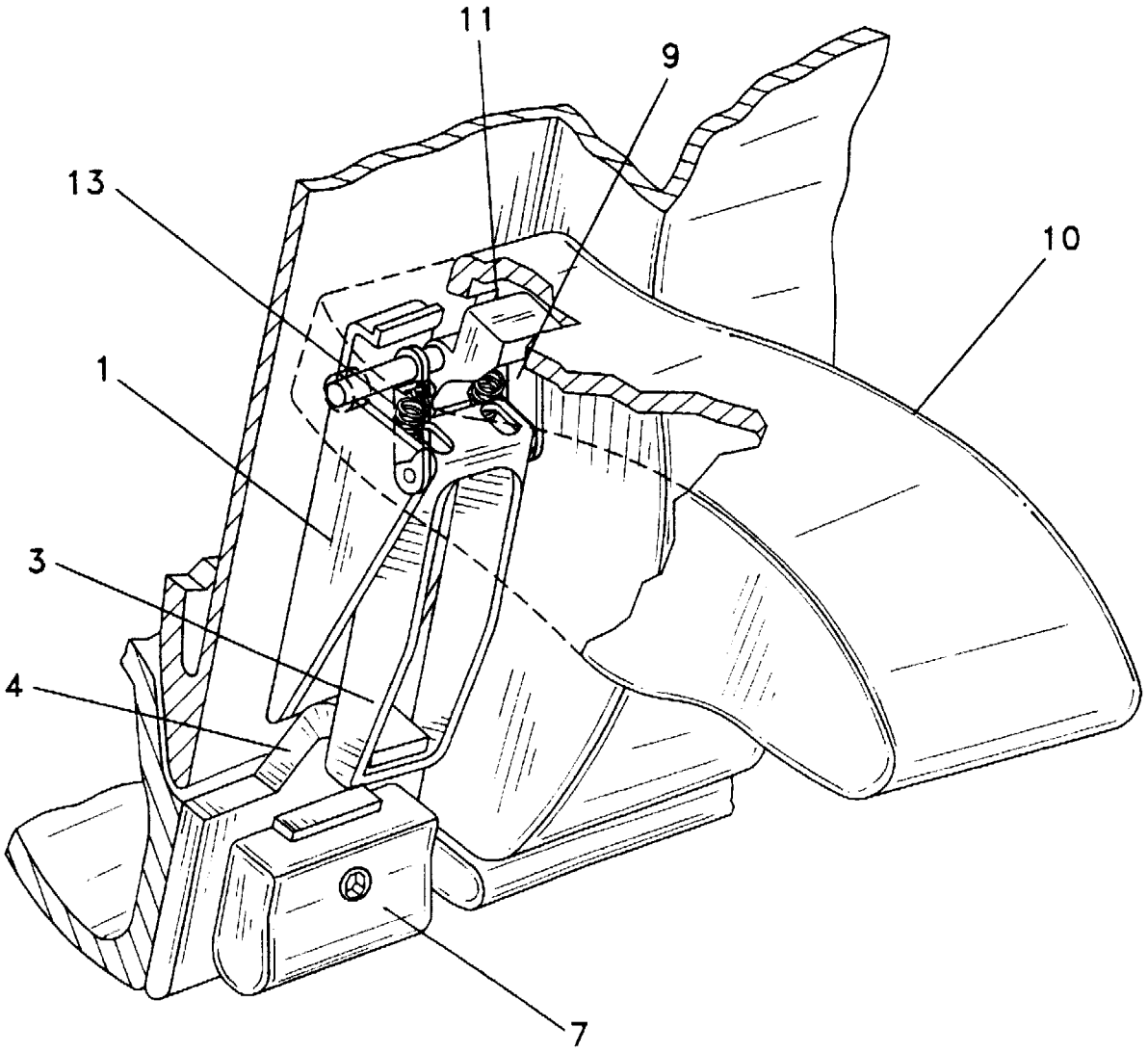
FIG. 2 is a diagram showing the first example latch in a partially closed position.

The third lever 11 protrudes through an opening in the second lever 10, and to release the latch a user depresses the third lever 11 to disengage the hooked end 13 and the lip 14. The pivotally connected end 17 of second lever 10 is then pulled away from the first member 2 and can be brought back into the position shown in FIG. 2 by rotation of the end 12 of the second lever 10 away from the strike block 5. Further rotation of the second lever 10 in the same direction urges the hooked end 13 of the third lever 11 onto the end of the first lever 3, which is then caused to move and disengage from the strike block 5.

The strike block component 7 is adjustable so that a user can alter the strength of seal that is provided when the second lever 10 engages with it.

Figure 5A:
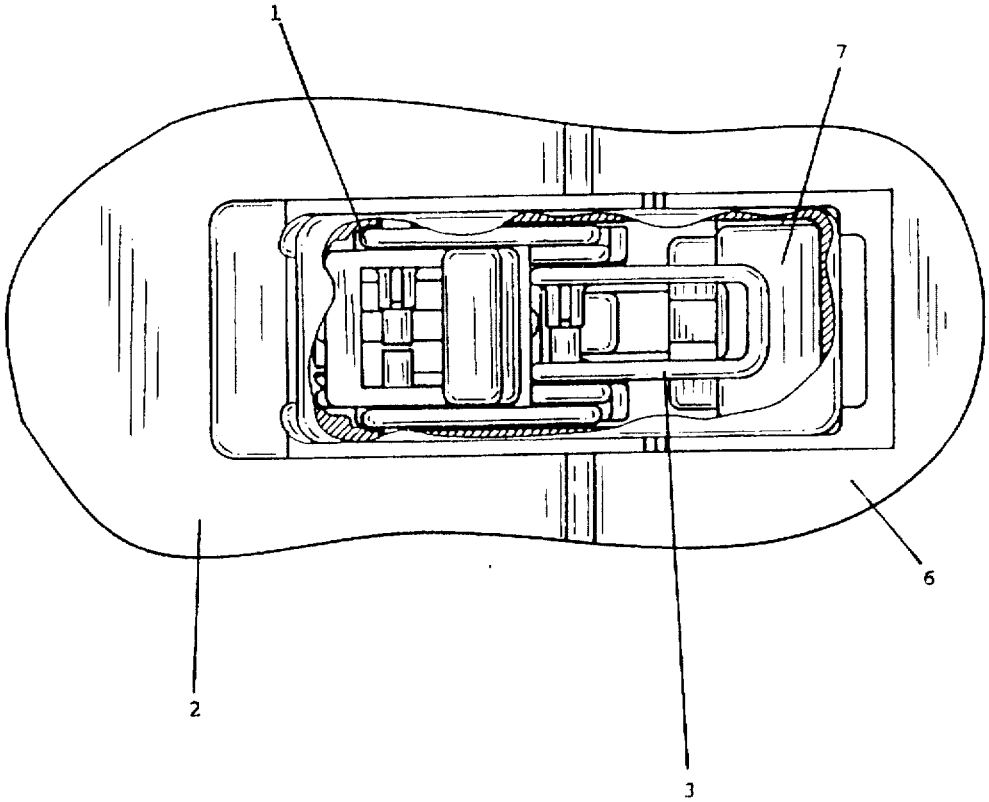
FIGS. 5A and 5B are diagrams showing plan and side views of a second example latch in a fully engaged position; and, FIGS. 6A and 6B are side views of the second example latch in partially engaged positions.
Figure 5B:
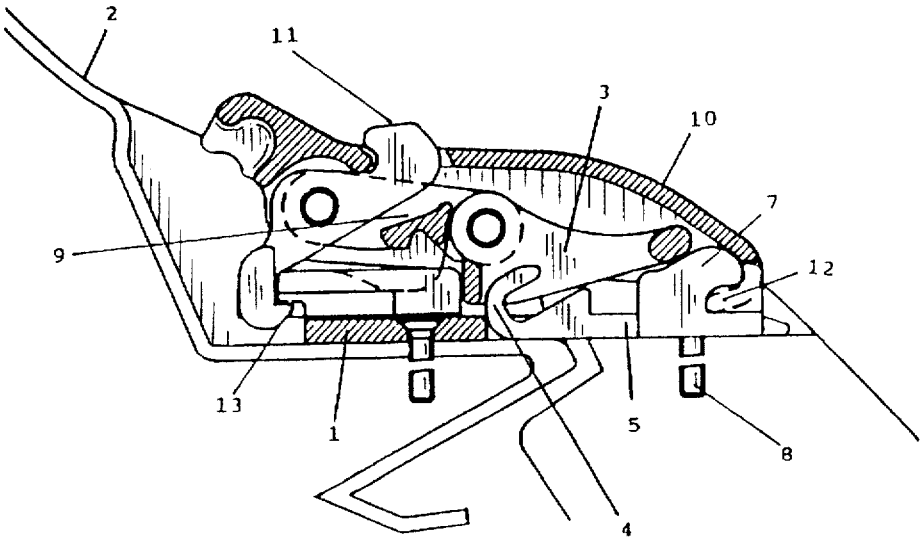
Figure 6A:
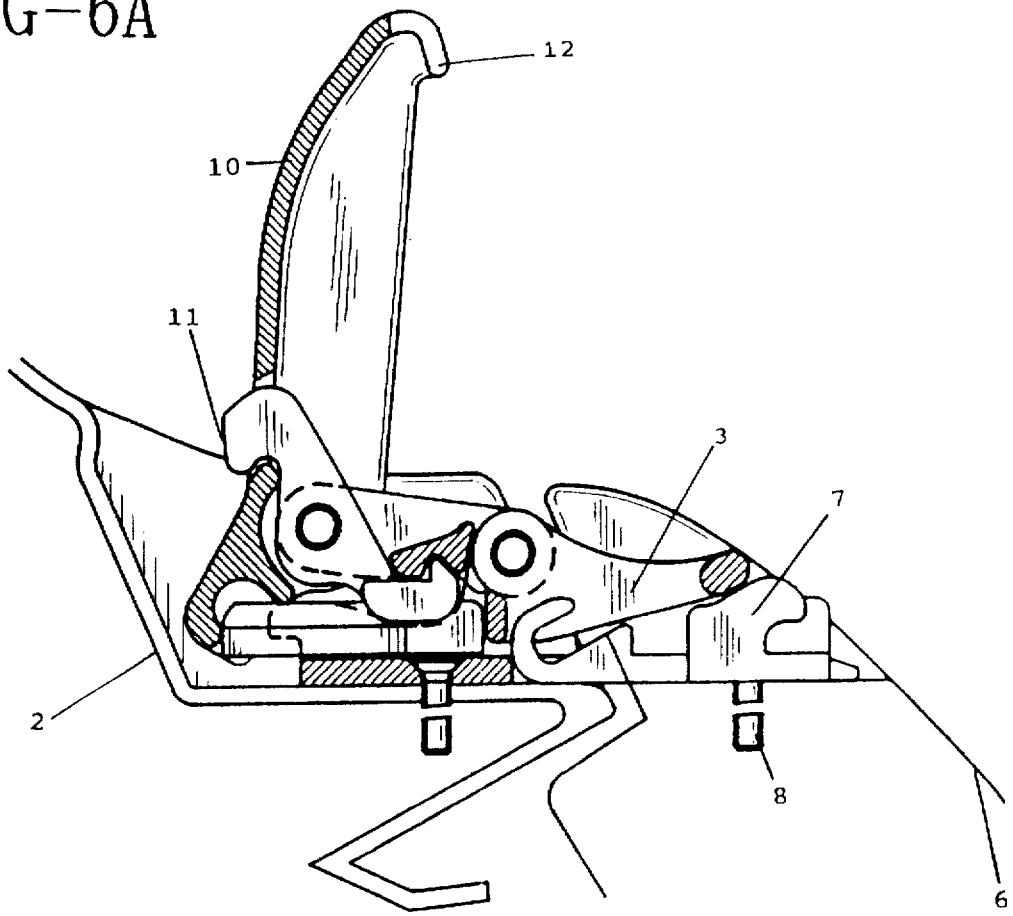
Figure 6B:
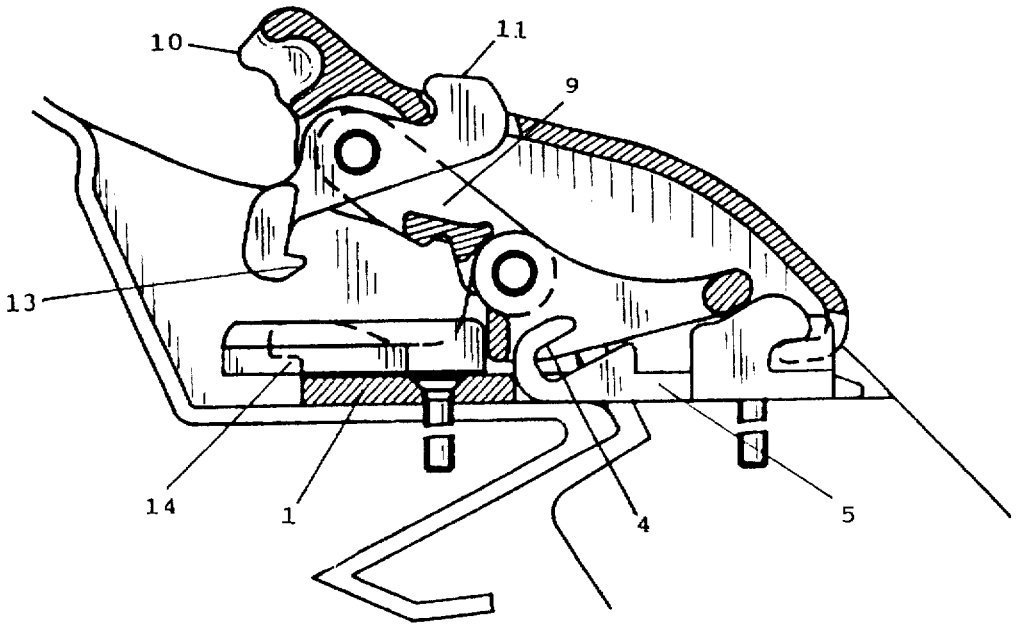

The second example latch of FIGS. 5 and 6 is similar in operation to the first example latch of FIGS. 1 to 5, and corresponding components have been identically numbered. In this example, however, the free end of the second lever 10 is shaped so as to hook on to the component 7 when the latch is in the engaged position, so that a firmer engagement between the two members 2,6 can be provided. Also, this example provides the biasing spring 15 on the pivot axis of the second 10 and third 11 levers, simplifying the assembly of the lever as a whole.

We claim:

1. A latch comprising:

a support block which, in use, is attached to a first member;

a strike block which, in use, is attached to a second member;

a first lever attached to the support block and shaped to engage with the strike block when the first and second members come into contact;

a link member, pivotally attached to the support block;

a second lever, pivotally attached to the link member and shaped to engage with the strike block;

a third lever, pivotally attached to the link member and engagable with the support block, to retain the latch in a latched position; and, biasing means for biasing the third lever into engagement with the support block when the second lever is in its engaged position.

2. A latch according to claim 1, in which the strike block comprises two components, the first of which engages with the first lever, and the second of which is adjustably mounted on the first to provide an adjustable engagement with the second lever.

3. A latch according to claim 1, in which the biasing means is a spring or a combination of springs.

4. A latch according to claim 1, in which the biasing means acts to bias the second lever into a warning position when it is not fully engaged.

5. A latch according to claim 1, in which the biasing means biases the first lever towards an engaging position.

6. A latch according to claim 1, in which the first lever is urged by the third lever to disengage the first lever from the support block upon rotation of the second lever to an open position.

7. A latch according to claim 1, in which the third lever engages with the support block to provide a locking function.

8. A latch according to claim 1, in which the second lever is biased to a position in which its free end projects outwardly from the support block.

9. A latch according to claim 1, in which there is a common biasing means for the second lever and the third lever.

10. A latch according to claim 9, in which the biasing means is a spring, which can be attached to the support block or first lever at one end and attached to the third lever at its other end.

11. A latch according to claim 9, in which the biasing means is a torsion spring attached to the third lever and in engagement with the first lever, the second lever or support block to bias the third lever toward an engaged position.

* * * * *